United States Patent [19]

Champion

[11] Patent Number: 4,962,950

[45] Date of Patent: Oct. 16, 1990

[54] APPARATUS FOR INCREASING ATTENDANCE AT PARIMUTUEL EVENTS

[76] Inventor: Joseph S. Champion, P.O. Box 13216, Lexington, Ky. 40583

[21] Appl. No.: 421,193

[22] Filed: Oct. 13, 1989

[51] Int. Cl.[5] ..... B72D 15/00

[52] U.S. Cl. ..... 283/67; 283/901; 283/903; 283/117; 283/94; 283/53; 283/70; 283/62; 281/2; 281/5; 281/51

[58] Field of Search ..... 283/72, 903, 67, 901, 283/117, 94, 74, 81, 105, 53, 51, 70, 62; 281/15.1, 2, 5, 51

[56] References Cited

U.S. PATENT DOCUMENTS

| | | | |
|---|---|---|---|
| 1,567,560 | 12/1925 | Worth | 283/903 |
| 2,309,178 | 1/1943 | Fallon et al. | 283/70 |
| 2,925,288 | 2/1960 | Weingart | 283/62 |
| 3,397,886 | 8/1968 | Dopieralski | 283/49 |
| 4,033,611 | 7/1977 | Johnsen | 283/6 |
| 4,251,093 | 2/1981 | Tobin | 283/60 |
| 4,705,301 | 11/1987 | Dojel | 283/105 |
| 4,716,948 | 1/1988 | Brissette | 150/132 |
| 4,778,153 | 10/1988 | Bachman et al. | 283/101 |
| 4,787,950 | 11/1988 | Meloni et al. | 156/429 |

*Primary Examiner*—Douglas D. Watts
*Assistant Examiner*—Thomas Hamill, Jr.
*Attorney, Agent, or Firm*—King & Schickli

[57] ABSTRACT

An admission ticket is designed to increase both the betting interest and attendance by the public at a parimutuel event such as a horse race. The ticket includes a pass stub used to gain entry to the parimutuel event and a wagering stub which may be exchanged for a bet at the parimutuel event. Preferably, the pass stub and wagering stub are printed on a single piece of paperboard material and are separated by a perforation line. The wagering stub includes a concealed wager and a concealed means for limiting the use of the wager by a patron at the parimutuel event. The method of the invention includes a step of printing an admission ticket to a parimutuel event with a wager being awarded to a patron and a means for limiting the use of the wager by the patron. The method also includes the step of concealing the wager and wager limiting means from the patron prior to purchase of the admission ticket and revealing the wager and wager limiting means to the patron subsequent to the purchase of the admission ticket.

8 Claims, 2 Drawing Sheets

APPARATUS FOR INCREASING ATTENDANCE AT PARIMUTUEL EVENTS

TECHNICAL FIELD

The present invention relates generally to the event promotion field and, more particularly, to an apparatus and method for increasing the betting interest and attendance by the public at parimutuel events.

BACKGROUND OF THE INVENTION

Parimutuel horse racing has been approved by the governments of a majority of the states. It has been found that it is a very effective way for the states to raise revenue through receiving a percentage of the total amount of money wagered by the public on the horse races.

Until recently, public attendance at the horse races had been generally on the rise. With the legalization of simulcasting (i.e. the broadcasting of the races as they are run to a location, other than the race track, allowing wagering by the public) and the establishment of lotteries in states where parimutuel horse racing already exists, however, attendance at the race track has significantly declined. Accordingly, a need exists for a promotional activity which will again bring the public to the race tracks in increasing numbers.

In order to achieve this end, a number of race tracks utilize special days wherein patrons attending the races are given gifts such as caps or rain slickers. Additionally, patrons may be given an opportunity to win a larger prize such as a car or dream vacation through a drawing from the names of the patrons attending the races.

The shortcoming of these type of promotional activities relates to the fact that they do not in any way increase the betting knowledge and interest of the public attending the races. This is a critical factor in developing and expanding a core segment of the public who will return regularly to the race track.

SUMMARY OF THE INVENTION

Accordingly, it is a primary object of the present invention to provide a method and apparatus for promoting parimutuel events, such as thoroughbred, quarter horse and harness horse racing, dog races, steeplechase events and jai alai, which overcome the above-described limitations and disadvantages of the prior art promotional activities.

Another object of the present invention is to provide an apparatus and method designed to increase the betting knowledge and interest as well as attendance of the public at parimutuel events.

An additional object of the present invention is to provide an admission ticket for a parimutuel event which awards the purchaser patron with a wager that may be placed by the patron upon a selected betting interest.

Still another object of the present invention is to provide an admission ticket to a parimutuel event that not only awards the purchaser patron with a wager but includes the limitation of that wager to, for example, a particular betting interest, a particular race or a particular type of bet so as to educate and increase the interest of the public both in the sport and parimutuel wagering.

Additional objects, advantages and other novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention as described herein, a wagering stub is provided for a parimutuel event. The wagering stub is designed to increase betting interest and attendance by the public. The wagering stub includes a concealed wager and a concealed means for limiting the use of the wager by a patron at a parimutuel event. After purchase both the wager and wager limiting means may be revealed by the patron and used to make a bet. Advantageously, the wager stub may be attached to any official parimutuel event memorabilia or publications such as betting sheets and racing programs.

Preferably, an admission ticket for a parimutuel event designed to increase both betting interest and attendance by the public is provided. The ticket includes a pass stub to gain entrance to the parimutuel event and a wagering stub which may be exchanged for a bet at the parimutuel event. For example, the ticket may be made on printed paperboard with the pass stub and wagering stub separated along a perforation.

More specifically, the wagering stub includes both a wager and a means for limiting the use of the wager by a patron at the parimutuel event. Preferably, both the wager and the wager limiting means are concealed when the admission ticket is purchased so that the purchaser will have no idea as to what he or she is being awarded by the wagering stub. A number of procedures for concealing this information are known in the art. Examples include (a) an overlying material that may be scratched off with, for example, the edge of a coin, (b) a peel-off opaque covering or (c) a photo labeling system wherein the information is only detectable when the wagering stub is radiated with light of a particular wave length. This could be done by officials at the parimutuel event if desired.

Any concept for limiting the utilization of the wager by the patron could be developed and utilized. The primary purpose of limiting the use of the wager is to educate the public with respect to parimutuel wagering and the sport on which the wagering is being conducted. In this way, the betting knowledge and interest of the patrons is increased and accordingly the patrons are more likely to return to the parimutuel event in the future.

In accordance with one concept for wager limiting, the wager limiting means identifies a particular type of bet for which the wager must be used. For example, parimutuel wagering at horse race tracks today offers the public a large number of betting options including win, place and show wagering as well as more exotic bets such as daily double, exacta, perfecta, trifecta and pick six wagering. Under this concept, the patron would have to use the awarded wager on one of these types of bets.

In accordance with another concept, the wager limiting means identifies a particular race on which the wager must be used. In this situation, the patron would have to use the awarded wager toward a win, place or show bet on a particular horse from the particular race in question. Alternatively, if a form of exotic wagering, such as an exacta, is available on the particular race in question, the awarded wager could be used toward this type of bet.

In accordance with yet another concept for limiting the use of the wager, the wager limiting means identifies a particular betting interest at the parimutuel event on which the wager must be used. This betting interest could be a particular horse, a particular jockey or a particular horse number. In the first situation, the patron could only use the wager to bet on the particular horse identified. Thus, the wager could only be used on a day and during a race when that particular horse is running at the race track. In the second situation, the patron could use the wager to bet on any horse on which the identified jockey is riding. In the third situation, the patron could place the wager on any horse with the identified number during any particular race at the parimutuel event in which that number horse is running.

In accordance with a further aspect of the present invention, a method for increasing both betting interest and attendance by the public at a parimutuel event is provided. The method includes the step of printing an admission ticket to the parimutuel event with a wager being awarded to a patron and a means for limiting the use of the awarded wager by the patron. As discussed above, an important aspect of the invention is the concealing of the wager and wager limiting means from the patron prior to purchase of the admission ticket. Further, the method includes the step of revealing the wager and wager limiting means to the patron subsequent to the purchase of the admission ticket. Preferably, this revealing step is completed upon admission of the patron to the parimutuel event thereby ensuring attendance of the patron at the race track.

Still other objects of the present invention will become readily apparent to those skilled in the art from the following description wherein there is shown and described a preferred embodiment of this invention, simply by way of illustration of one of the modes best suited to carry out the invention. As will be realized, the invention is capable of other different embodiments, and its several details are capable of modifications in various, obvious aspects all without departing from the invention. Accordingly, the drawing and description will be regarded as illustrative in nature and not as restrictive.

BRIEF DESCRIPTION OF THE DRAWING

The accompanying drawing incorporated in and forming a part of the specification, illustrates several aspects of the present invention and together with the description serves to explain the principles of the invention. In the drawing.

Figure 1:
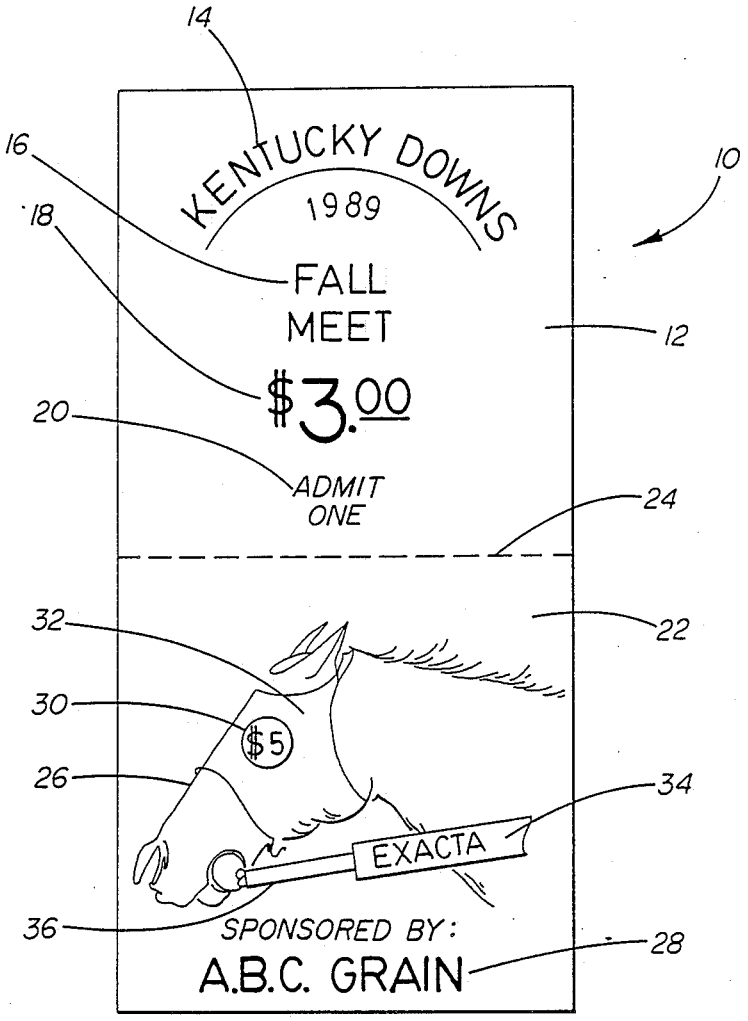
FIG. 1 is a top plan view of the admission ticket of the present invention.

Reference will now be made in detail to the present preferred embodiment of the invention, an example of which is illustrated in the accompanying drawing.

DETAILED DESCRIPTION OF THE INVENTION

Reference is now made to the drawing figure showing the admission ticket 10 of the present invention. The admission ticket 10 is especially adapted for increasing the betting knowledge and interest as well as attendance by the public at a parimutuel event such as a horse race. As shown, the ticket 10 includes a pass stub 12. The pass stub 12 is utilized to gain entry to the parimutuel event. Of course, the pass stub 12 has some basic information printed thereon including, for example; the name of the facility or organization at which the parimutuel event is taking place at 14; the particular meet or day for which the pass stub is valid at 16; the cost of the admission ticket at 18; and an explanation as to the fact that the pass stub is valid to admit one to the event at 20.

The ticket 10 also includes a wagering stub 22. The pass stub 12 and wagering stub 22 may be printed on a piece of paperboard material and separated by a perforation 24. Thus, upon gaining entry to the parimutuel event, the pass stub 12 and wagering stub 22 may be separated by tearing along the perforation 24 and the pass stub retained by the representative of the parimutuel event while the wagering stub is returned to the patron. As shown, the wagering stub 22 may include some graphics 26 relative to the horse racing event. Additionally, the wagering stub 22 may include an advertising section 28 wherein the name of a wager sponsor is printed for promotional purposes.

The wagering stub 22 also includes a wager 30 that is awarded to the patron who purchases the ticket. As shown in the example the wager 30 appears in a box on the running horse graphic 26. A $5.00 wager 30 is shown in the figure. It should be recognized, however, that any denomination of wager 30 may be provided as desired.

In addition, the wagering stub 22 includes a means 34 for limiting the use of the wager 30. As shown, the wager limiting means 34 may be printed in a second box on the running horse graphic 26.

Figure 2:
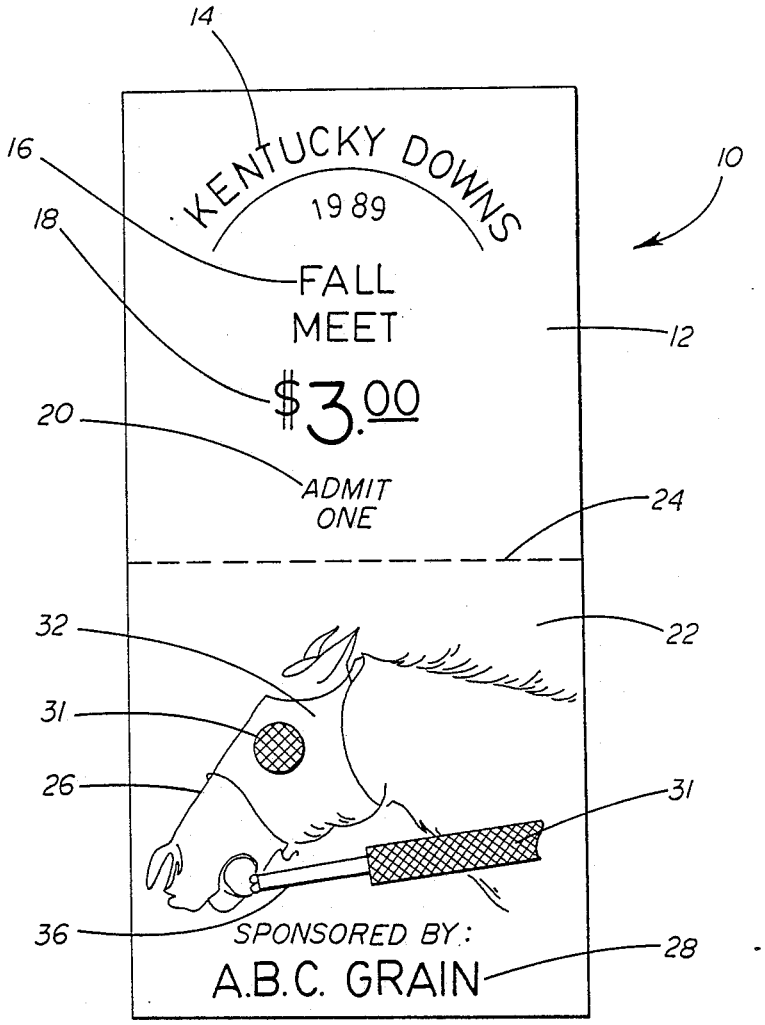
FIG. 2 is a top plan view of the admission ticket of the present invention showing the opaque covering of the wager and wager limiting means.

In the preferred embodiment, when the ticket 10 is purchased by the patron, both the wager 30 and wager limiting means 34 are concealed. This may be accomplished by any means known in the art including the covering of the ,wager 30 and wager limiting means 34 with a material 31 (see FIG. 2) that may be scratched from the ticket 10 by, for example, the use of an edge of a coin. A peel-off opaque strip of tape or other material may also be provided to cover the wager 30 and wager limiting means 34. As yet another alternative, the wager 30 and wager limiting means 34 may be printed so as to only be discernible when the wagering stub 22 is subjected to light at a particular wave length. A device for producing light at the selected wave length may be provided at the horse race facility holding the parimutuel event. In this way, the patron does not know the amount of the wager 30 or the limits on the wager's use until actually reaching the facility and gaining entry to the event.

It should be appreciated that the wager limiting means 34 is an important aspect of the present invention. More particularly, by limiting in certain ways the use of the wager 30 by the purchaser patron, it is possible to educate the patron with respect to both parimutuel wagering in general and, for example, the horse racing sport upon which the wagering is being conducted in particular. Advantageously, through education of the patrons in this manner, and the provision of a wager 30 which the patrons may bet, the knowledge and betting interest of the public is increased. This serves to also increase the likelihood that a particular patron will return to the parimutuel event in the future thereby significantly raising public attendance at the parimutuel event over time.

A number of approaches may be utilized to limit the use of the wager 30 in the manner described. For example, wager limiting means 34 may identify a particular type of bet for which the wager 30 must be used. Thus, as shown in the drawing figure, wager limiting means 34 may state "exacta". This means that the patron must use the $5.00 wager 30 on an exacta bet. If the patron is unfamiliar with what an exacta bet is, the patron must refer to information provided by the parimutuel event officials to discover that an exacta bet requires the selection of the first and second place finishers in the exact order in any one particular race. Armed with this knowledge, the patron may then make the appropriate bet and become involved in the spirit of the horse races by attempting to "root home" the chosen horses.

An alternative wagering limiting means 34 that could be utilized in accordance with the present invention identifies a particular race on which the wager must be used. Thus, for example, in this situation, the box showing the wager limiting means 34 would, for example, state "race number 3". With this type of limitation, the wager 30 must be placed on any horse or horses running in the third race.

Another wager limiting means 34 identifies a particular betting interest at the parimutuel event on which the wager 30 must be used. The particular betting interest could, for example, be a particular horse or a particular jockey identified by name. In the former instance, the wager 30 must be placed on the name of the horse identified by the wager limiting means 34 on the wagering stub 22. The patron would then be required to determine in which race that horse was running. In certain instances, the patron may in fact have to return to the racing facility on a different day in order to place the wager 30 on the identified horse.

In the latter instance, the patron would need to refer to racing information to determine during which races and on which horses the identified jockey will be riding. The patron then must select one of the horses being ridden by the identified jockey as the horse on which the wager 30 is placed.

The method of the present invention includes the printing of an admission ticket to the parimutuel event with a wager 30 being awarded to a patron and a means 34 for limiting the use of the wager by the patron. The method also includes the concealing of the wager 30 and wager limiting means 34 from the patron prior to purchase of the admission ticket. This should serve to help encourage ticket purchases as everyone will have a chance to be awarded a large wager 30 yet there will be no way to readily identify such a ticket. Finally, the method also includes the step of revealing the wager 30 and wager limiting means 24 to the patron subsequent to the purchase of the ticket.

Preferably, as discussed above, the revealing step is completed after gaining entry to the parimutuel event. This could be accomplished in any number of ways. For example, where the wager 30 and wager limiting means 34 are concealed by an opaque tape, admissions officials at the parimutuel event would only return those wagering stubs 22 to patrons where the concealing tape was still intact. Where the tape had previously been removed, the wagering stub 22 would be forfeited. Of course, the ticket 10 would instruct the patron as to this requirement.

In summary, numerous benefits have been described which result from employing the concepts of the present invention. Advantageously, the admission ticket 10 of the present invention increases both the attendance and betting interest of the public in the parimutuel event. Additionally, it serves to educate the public with respect to parimutuel wagering in general and the sport on which the wager is taking place in particular.

The foregoing description of the preferred embodiment has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

I claim:

1. An admission ticket for a parimutuel event designed to increase both betting interest and attendance by the public, comprising:

a single sheet including a pass stub and a wagering stub separated by a fold line, said pass stub to gain entrance to said parimutuel event and said wagering stub to be exchanged for a bet at said parimutuel event;

wager indicia printed on said wagering stub identifying a wager which may be made by a patron;

a first removable opaque portion overlaying and concealing said wager indicia;

indicia means printed on said wagering stub for limiting the use of said wager by a patron at said parimutuel event; and a second removable opaque portion overlying and concealing said indicia means for limiting the use of said wager.

2. The admission ticket of claim 1, wherein said wager limiting indicia means identifies a particular type of bet for which said wager must be used.

3. The admission ticket of claim 1, wherein said wager limiting indicia means identifies a particular race on which said wager must be used.

4. The admission ticket of claim 1, wherein said wager limiting indicia means identifies a particular betting interest at said parimutuel event on which said wager must be used.

5. A wagering stub for a parimutuel event designed to increase both betting interest and attendance by the public, comprising:

a single sheet of material adapted to receive indicia;

wager indicia printed on said sheet for identifying a wager which may be made by a patron;

a first removable opaque portion overlying and concealing said wager indicia;

indicia means printed on said sheet for limiting the use of said wager by a patron at said parimutuel event; and a second removable opaque portion overlying and concealing said indicia means for limiting the use of said wager.

6. The wagering stub of claim 5, wherein said wager limiting indicia means identifies a particular type of bet for which said wager must be used.

7. The wagering stub of claim 5, wherein said wager limiting indicia means identifies a particular race on which said wager must be used.

8. The wagering stub of claim 5, wherein said wager limiting indicia means identifies a particular betting interest at said parimutuel event on which said wager must be used.

* * * * *